United States Patent [19]

Maguire, Jr. et al.

[11] 4,123,395

[45] Oct. 31, 1978

[54] COMPOSITIONS CONTAINING NONIONIC SURFACTANT AND SULFONATED AROMATIC COMPATIBILIZING AGENT

[75] Inventors: Edward J. Maguire, Jr.; Robert A. Staab, both of Cincinnati, Ohio

[73] Assignee: The Procter & Gamble Company, Cincinnati, Ohio

[21] Appl. No.: 837,343

[22] Filed: Sep. 28, 1977

Related U.S. Application Data

[63] Continuation of Ser. No. 635,831, Nov. 28, 1975, abandoned, which is a continuation-in-part of Ser. No. 479,953, Jun. 17, 1974, abandoned.

[51] Int. Cl.[2] ..... C11D 3/34; C11D 1/831; C11D 1/83

[52] U.S. Cl. ..... 252/559; 252/89 R; 252/321; 252/358; 252/540; 252/DIG. 1; 252/DIG. 15

[58] Field of Search ..... 252/559, 540, 529, 321, 252/358, 89 R, DIG. 1, DIG. 12, DIG. 15

[56] References Cited

U.S. PATENT DOCUMENTS

| | | | |
|---|---|---|---|
| 2,340,035 | 1/1944 | Zimmer et al. | 252/321 |
| 3,250,727 | 5/1966 | Noll et al. | 252/321 |
| 3,314,891 | 4/1967 | Schmulka et al. | 252/89 |
| 3,679,589 | 7/1972 | Scanegelberger et al. | 252/321 |
| 4,001,132 | 1/1977 | Maguire | 252/105 |

FOREIGN PATENT DOCUMENTS 73-17,643 5/1973 Japan.

*Primary Examiner*—Harris A. Pitlick
*Attorney, Agent, or Firm*—Steven J. Goldstein; Robert B. Aylor; Richard C. Witte

[57] ABSTRACT

Bleach-free detergent compositions for use in automatic dishwashers comprising an alkoxylated nonionic surface-active agent and a sulfonated aromatic compatibilizing agent. Preferred nonionic surfactants include ethoxylated nonionics and preferred compatibilizing agents can be selected from xylene-, toluene-, cumene-, benzene-, trimethylbenzene-, ethylbenzene- and ethylmethylbenzenesulfonate. The instant compositions possess enhanced anti-redepositon properties for soils composed of grease and grease-protein complexes thereby providing impeccably cleaned objects which are virtually free of spots and streaks.

31 Claims, No Drawings

COMPOSITIONS CONTAINING NONIONIC SURFACTANT AND SULFONATED AROMATIC COMPATIBILIZING AGENT

CROSS REFERENCE TO RELATED APPLICATION

This is a continuation of application Ser. No. 635,831, filed Nov. 28, 1975, now abandoned, which is a continuation-in-part of Ser. No. 479,953, filed June 17, 1974, now abandoned.

BACKGROUND OF THE INVENTION

This invention relates to detergent cleaning compositions which are particularly suitable for use in automatic dishwashers. In detail, the compositions herein comprise a binary active system consisting of an alkoxylated nonionic surface-active agent and a compatibilizing agent, and are free of chlorine-containing bleach components. The constituents of the binary active system are present in major amounts preferably in about equiponderant quantities. The compositions herein provide, during conventional use, markedly enhanced anti-redeposition benefits, particulary for soils composed of grease and grease-protein complexes. The compositions are preferably prepared either in granular form or in the form of a viscous paste or gel. The instant compositions, in addition to the essential components listed, can further comprise conventional dishwashing composition additives in the art-established levels for their known functions. Examples of such additives include sodium silicate solids, sodium carbonate, sodium bicarbonate, sodium sulfate and sodium phosphate.

Conventional automatic dishwashing compositions normally contain a low-foaming surface-active agent, a chlorine bleach, alkaline builder materials, and usual minor ingredients and additives. The incorporation of chlorine bleaches requires special processing and storage precautions to protect components which are subject to deterioration upon direct contact with active chlorine. In addition, the stability of the chlorine bleach is critical and raises additional processing and storage difficulties. It is also known that the chlorine-containing bleaches which are normally used in automatic dishwashing detergent compositions can tarnish silverware and can damage metal trim on china. Accordingly, there is a standing desire to formulate automatic dishwashing detergent compositions which are free of active chlorine and which are capable of providing overall hard surface cleaning and appearance benefits comparable to or better than active chlorine-containing detergent compositions. This reformulation is particularly delicate considering that during automatic dishwashing operations, active chlorine prevents the formation and/or deposition of troublesome proteins and protein-grease complexes on the hard surfaces and no surfactant is currently known which is capable of adequately performing that function.

The disclosure of U.S. Pat. No. 3,549,539 to Mallows relate to machine dishwashing powders containing a nonylphenol-5-EO or a condensation product of a random $C_{11}$ to $C_{15}$ secondary alcohol and ethylene oxide with an HLB (hydrophilic-lipophilic balance) value between 11.5 and 13.5 and polyethylene oxide-polypropyleneoxide condensate that consists of between 5 and 25% polyethyleneoxide and 95 to 75% polypropyleneoxide and has a molecular weight between 1500 and 2700. It is disclosed that, in addition to the above surfactant combination, the machine dishwashing powder will normally contain from 5 to 30% of a silicate such as sodium metasilicate, from 5 to 30% of an oxidizing agent, from 25 to 70% of a calcium-ion sequestrant and from 1 to 20% of an inorganic filler salt, such as sodium carbonate or sodium sulfate. The oxidizing agents can be represented by chlorinated sodium orthophosphate, chlorinated isocyanurate and perborate possibly with a copper catalyst or an organic activator. Additional disclosures relative to bleach-containing detergent compositions for use in automatic dishwashers can be found in, for example, U.S. Pat. Nos. 3,410,804; 3,390,092; 3,248,330 and 3,595,968.

Various attempts have also been made to formulate bleach-free low-foaming detergent compositions for automatic dishwashing machines containing particular low-foaming nonionics, builders and filler materials and additives adapted to provide a particular function. For example, U.S. Pat. No. 3,022,250 to Grifo relates to low sudsing detergent compositions especially adapted for use in automatic dishwashing machines containing a phenol having therein an aliphatic substituent with an average of 9 carbon atoms per chain and a second substituent comprising condensed ethylene oxide in an average number of 4 molecules per molecule of phenol together with builders consisting essentially of a mixture of sodium metasilicate and sodium tripolyphosphate in the proportion of 1 part of metasilicate to 3 parts of tripolyphosphate, the builders being present in the proportion of 95 parts of builder mixture to 5 parts of alkyl phenol ethylene oxide. The disclosures of U.S. Pat. No. 3,048,548 to Martin et al. relate to substantially identical subject matter wherein the nonionic low-foaming surface-active agent can be represented by very specific polyoxyalkylene glycol mixtures. U.S. Pat. No. 3,382,178 to Lissant et al. also pertains to automatic dishwashing compositions comprising a de-foaming nonionic surfactant having a specific formula and a small amount of an anti-oxidant for the purpose of reducing, inhibiting and/or preventing alkali degradation of the nonionic surfactant thereby rendering it stable in alkaline detergents, particularly during prolonged storage.

U.S. Pat. No. 3,574,122 to Payne et al relates to stable aqueous emulsions which are intended for use as laundry detergents and which contain nonionic surfactant and, as part of an emulsion stabilizer system, a hydrotropic material. Belgian Pat. No. 824,591 discloses an abrasive composition containing a silicaceous abrasive, an anionic detergent, especially alkyl benzene sulfonate, and a hydrotropic material such as sodium cumene sulfonate.

While the prior art clearly recognizes the disadvantages of using aggressive chlorine bleaches in automatic dishwashing operations and also suggests bleach-free compositions by merely leaving out the bleach component, said art does not disclose or suggest the subject combination of alkoxylated nonionic surfactants and particular compatibilizing agents, leave alone predicting the performance advantages attainable from using the instant compositions in automatic dishwashing operations.

Concurrently filed U.S. patent application Ser. No. 635,830, now abandoned, entitled: ENZYME-CONTAINING AUTOMATIC DISHWASHING DETERGENT COMPOSITION; Inventors: Geoffrey Place and Edward J. Maguire, Jr., relates to bleach-free automatic dishwashing compositions comprising an alkoxylated nonionic surface-active agent, a sulfonated aromatic compatibilizing agent such as, for example, xylene-, toluene-, cumene-, and benzenesulfonate, and an enzyme having an iso-electric point greater than 8.5 copending U.S. Patent application Ser. No. 479,969, now U.S. Pat. No. 4,001,132 entitled: AUTOMATIC DISHWASHING DETERGENT COMPOSITION; Inventor: Edward J. Maguire, Jr., pertains to bleach-free detergent compositions for use in automatic dishwashers comprising an alkoxylated nonionic surface-active agent, a sulfonated aromatic compatibilizing agent such as, for example, xylene-, toluene-, cumene- and benzenesulfonate and a mixture of a water-soluble sulfite.

It is an object of this invention to provide bleach-free detergent compositions which can be used in automatic dishwashing operations.

It is an additional object of this invention to formulate an active system capable of improved redeposition characteristics particularly for soils composed of grease and grease-protein complexes.

The above and other objects can now be met by formulating bleach-free detergent compositions comprising a specific binary active system.

SUMMARY OF THE INVENTION

This invention is, in part, based on the discovery that highly effective automatic dishwashing compositions can now be formulated which are free of chlorine bleaches. In more detail, the compositions herein comprise:

(a) at least about 4% by weight of an alkoxylated nonionic surface-active agent wherein said alkoxy moiety is selected from the group consisting of ethylene oxide, propylene oxide and mixtures thereof; and (b) at least about 5% by weight of a sulfonated aromatic compatibilizing agent having a critical micelle concentration greater than about 1% by weight/volume at 25° C., wherein the weight ratio of said alkoxylated nonionic surface-active agent to said sulfonated compatibilizing agent is in the range from about 2:5 to 5:3;

the composition being substantially free of a chlorine bleach component and being in the form of a solid, a paste or a gel, or a non-aqueous liquid.

Although liquid compositions are not generally preferred, non-aqueous liquids are preferred over aqueous liquids because it is possible to obtain higher concentrations of active material, thus allowing the formulation of high-active products having little bulk, thereby being easier and cheaper to distribute.

In preferred embodiments of this invention, an ethoxylated nonionic surfactant is used in combination with a compatibilizing agent selected from the group consisting of toluene, xylene, cumene, benzene, trimethylbenzene, ethylbenzene, ethylmethylbenzene sulfonate and mixtures thereof. The preferred weight ratio of the alkoxylated nonionic to the compatibilizing agent is in the range from about 3:5 to about 5:4, especially about 1:1.

In one preferred embodiment of the invention, the composition is in the form of a solid, preferably granular, composition and comprises up to about 20% by weight of the nonionic surface-active agent and up to about 20% by weight of the aromatic compatibilizing agent. The binary active system in this embodiment thus represents from about 9% to about 40%. more preferably from about 10% to 30% of the solid detergent composition.

In a second embodiment of the invention, the composition is in the form of a viscous liquid, slurry, foam, paste or gel and comprises from about 20% to about 90%, more preferably from 30% to 80%, of the binary active system. It is generally important that automatic dishwashing machine products are retained in some form of dispenser prior to use. The dispenser provided in most machines is not fluid-tight and the product form of this second embodiment should be such that the viscous liquid or paste does not leak from the dispenser. Generally, if the product is in liquid form, the liquid should be thixotropic (i.e., exhibit high viscosity when subjected to low stress and lower viscosity when subjected to high stress) or at least have a very high viscosity, e.g. in the range of 1,000–10,000,000 centipoise. Pasty compositions generally have viscosities above about 5000 centipoise and up to several million centipoise. In this embodiment, the composition can further include adjuvants such as aqueous or non-aqueous liquid solubilizing or suspending systems, and viscosity control additives.

DETAILED DESCRIPTION OF THE INVENTION

The automatic dishwashing detergent compositions of this invention comprise a (1) binary system and are (2) free of chlorine bleach components; these essential parameters are discussed in detail hereinafter.

Unless stated to the contrary the "percent" indications stand for percent by weight.

The binary active system for use herein is represented by a mixture of an alkoxylated nonionic surface-active agent and a sulfonated aromatic compatibilizing agent. The binary active mixture is used in an amount from about 9% to about 40%, preferably from about 10% to about 20%, in granular compositions, and from about 20% to about 90%, preferably from about 30% to 80%, in pasty or gelled compositions. Non-aqueous liquid compositions of low viscosity (e.g., under 1000 centipoise) are also possible but are not preferred because of the difficulty of dispensing such fluid materials in conventional dishwashing machines. The weight ratio of alkoxylated nonionic surfactant to compatibilizing agent is in the range from about 2:5 to about 5:3, preferably from about 3:5 to about 5:4, especially about 1:1. The mixture of alkoxylated nonionic surfactant and compatibilizing agent represents more than about 9% to provide superior anti-redeposition and drainage performance, thereby virtually eliminating all residual spots and streaks on the hard surfaces being cleaned. Using less than about 9% of the surfactant mixture creates surface drainage problems and accordingly will adversely affect the use of the subject compositions for the intended purpose.

The binary active system desirably is kept below about 20% in the case of a granular detergent composition. Using more than about 20% in the case of a granular detergent composition can contribute to a lumping and caking tendency of the product.

In the case of a paste-like, gelled or viscous liquid product, very much higher active levels can be tolerated. Thus, by choosing an appropriate nonionic surfactant and compatibilizing agent, it is possible to formulate a product in paste form which contains up to about 90% of the binary active system. Normally, small quantities of materials such as solubilizer, thickeners, and the like, will be included to provide stable easily-dispensed compositions.

As noted above, the performance advantages of the compositions herein can only be achieved for a narrow and specific weight ratio of alkoxylated nonionic surfactant to compatibilizing agent. The weight ratio of the nonionic ingredient to the compatibilizing agent clearly reveals that the latter is used as a major composition constituent. In fact, in a highly preferred embodiment about equiponderant quantities of the nonionic ingredient and the compatibilizer are used. Variations in the weight ratios of the surfactant and the compatibilizing agent outside of the ranges specified are detractive to the attainment of the superior performance supplied by the instant compositions. Especially, the relative amount of the compatibilizing agent becomes critical when the weight ratio of alkoxylated nonionic to compatibilizing agent approaches about 5:3.

The alkoxy moiety of the nonionic detergent is preferably selected from the group consisting of ethylene oxide, propylene oxide and mixtures thereof. Ethylene oxide represents the preferred condensation partner. The alkylene oxide moiety is condensed with a nonionic base material according to techniques known in the art. All alkoxylated nonionic detergents which are normally known to be suitable for use in detergent technology can be used herein. Examples of the like components include:

(1) The condensation product of one mole of a saturated or unsaturated, straight or branched chain carboxylic acid having from about 10 to about 18 carbon atoms with from about 20 to about 50 moles of ethylene oxide. The acid moiety can consist of mixtures of acid in the above delineated carbon atoms range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$ and 9% $C_{16}$ with 35 moles of ethylene oxide is a specific example of a nonionic containing a mixture of different chain lengths fatty acid moieties. Other specific examples of nonionics of this type are: the condensation product of one mole of palmitic acid with 40 moles of ethylene oxide; the condensation product of one mole of myristic acid with 35 moles of ethylene oxide; the condensation product of one mole of oleic acid with 45 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 5 to about 50 moles of ethylene oxide. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$ and 9% $C_{16}$ with 45 moles of ethylene oxide ($CNAE_{45}$) is a specific example of a nonionic containing a mixture of different chain length alcohol moieties. Other specific examples of nonionics of this type are the condensation products of one mole of tallow alcohol with from 6 to 20 moles of ethylene oxide; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

(3) Polyethylene glycols having a molecular weight of from about 1400 to about 30,000. For example, Dow Chemical Company manufactures these nonionics in molecular weights of 20,000, 9500, 7500, 4500, 3400 and 1450. All of these nonionics are waxlike solids which melt between 110° F. and 200° F.

(4) The condensation products of one mole of alkyl phenol wherein the alkyl chain contains from about 8 to about 18 carbon atoms with from about 4 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; the condensation products of one mole of hexadecyl phenol with 30 moles of ethylene oxide.

(5) The ethoxylated surfactants disclosed in U.S. Patent application Ser. No. 453,464, now abandoned, filed Mar. 21, 1974, inventor Jerome H. Collins, incorporated herein by reference, consisting essentially of a mixture of compounds having at least two levels of ethylene oxide addition and having the formula:

$$R_1 - R_2 - O(CH_2CH_2O)_nH$$

wherein $R_1$ is a linear alkyl residue and $R_2$ has the formula $$-CHR_3CH_2-$$

wherein $R_3$ is selected from the group consisting of hydrogen and mixtures thereof with not more than 40% by weight of lower alkyl, wherein $R_1$ and $R_2$ together form an alkyl residue having a mean chain length in the range of 8–15 carbon atoms, at least 65% by weight of said residue having a chain length within ± 1 carbon atom of the mean, wherein $3.5 < n < 6.5$, provided that the total amount of components in which $n = 0$ is not greater than 5% by weight and the total amount of components in which $n = 2$–7 inclusive is not less than 63% by weight, and the hydrophilic-lipophilic balance (HLB) of said ethoxylate material is in the range from 9.5–11.5, said surfactant composition being otherwise free of nonionic surfactants having an HLB outside of said range.

Low-foaming alkoxylated nonionics are preferred although other (than low-foaming) alkoxylated nonionics can be used without departing from the spirit of this invention. Examples of nonionic low-foaming surface-active components include the condensation products of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; polyetheresters of the formula $$(ClC_6H_4)_2CHCO_2(CH_2.CH_2.O)_xR$$

wherein $x$ is an integer from 4 to 20 and R is a lower alkyl group containing not more than 4 carbon atoms, for example a component having the formula $$(ClC_6H_4)_2CHCO_2(CH_2CH_2O)_{15}.CH_3;$$

the polyalkoxylation products of alkyl phenol as, for example, the polyglycol alkyl phenol ethers containing an alkyl group having at least 6 and, normally, from about 8 to about 20 carbon atoms and having a molar ratio of ethylene oxide to condensate of about 7.5; 8.5; 11.5; 20.5 and 30. The alkyl group can, for example, be represented by di-isobutylene; di-amyl, polymerized propylene; iso-octyl; and nonyl.

Additional examples of effective low-foaming nonionics include: the polyoxyalkylene glycol condensates of U.S. Pat. No. 3,048,548, hereby incorporated by reference, having alternating hydrophilic oxyethylene chains and hydrophobic oxypropylene chains wherein the weight of terminal hydrophobic chains, the weight of the middle hydrophobic unit and the weight of the linking hydrophilic units each represent under one-third of the condensate; the de-foaming nonionic surfactants disclosed in U.S. Pat. No. 3,382,178, incorporated herein by reference, having the general formula $$Z[(OR)_nOH]_z$$

wherein Z is A-oxylatable material, A is the radical derived from an alkylene oxide which can be ethylene and propylene and $n$ is an integer from for example 10 to 2000 or more and $z$ is an integer determined by the number of reactive oxyalkylatable groups. Z can be represented by normal biodegradable alcohols such as for example octane by reduction of fatty acids derived from coconut oil, palm kernel oil, tallow and also those obtained from petroleum such as for example the mixtures of $C_{10}$ to $C_{18}$ straight-chain primary alcohols; the nonionic surface-active agents of U.S. Pat. No. 3,549,539 being a mixture of nonylphenol-5-EO or the condensation product of a random $C_{11}$ to $C_{15}$ secondary alcohol and ethylene oxide where an HLB value between 11.5 and 13.5; and a polyethylene oxide polypropylene oxide condensate that consists of between 5 and 25% polyethylene oxide and 95 and 75% polypropylene oxide and has a molecular weight between 1500 and 2700; the conjugated polyoxyalkylene compounds described in U.S. Pat. No. 2,677,700, incorporated herein by reference, corresponding to the formula:

$$Y(C_3H_6O)_n(C_2H_4O)_mH$$

wherein Y is the residue of organic compound having from about 1 to 6 carbon atoms and one reactive hydrogen atom, $n$ has an average value of at least about 6.4, as determined by hydroxyl number and $m$ has a value such that the oxyethylene portion constitutes about 10 to 90 weight percent of the molecule; the conjugated polyoxyalkylene compounds described in U.S. Pat. No. 2,674,619, incorporated herein by reference, having the formula:

$$Y[(C_3H_6O)_n(C_2H_4O)_mH]_x$$

wherein Y is the residue of an organic compound having from about 2 to 6 carbon atoms and containing $x$ reactive hydrogen atoms in which $x$ has a value of at least about 2, $n$ has a value such that the molecular weight of the polyoxypropylene hydrophobic base is at least about 900 and $m$ has a value such that the oxyethylene content of the molecule is from about 10 to 90 weight percent. Compounds falling within the scope of the definition for Y include, for example, propylene glycol, glycerine, pentaerythritol, trimethylolpropane, ethylene diamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula:

$$P[(C_3H_6O)_n(C_2H_4O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxypropylene portion is at least about 58 and $m$ has a value such that the oxyethylene content of the molecule is from about 10 to 90 weight percent of the formula:

$$P[(C_2H_4O)_n(C_3H_6O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxyethylene portion is at least about 44 and $m$ has a value such that the oxypropylene content of the molecule is from about 10 to 90 weight percent. In either case the oxypropylene chains may contain optionally, but advantageously, small amounts of ethylene oxide and the oxyethylene chains may contain also optionally, but advantageously, small amounts of propylene oxide.

Highly preferred alkoxylated nonionics for use herein include the condensation product of one mole of tallow alcohol with from about 6 to about 20 moles, especially 9 moles of ethylene oxide; and also the alkoxylate commercially available under the tradename PLURADOT HA-433$^{(R)}$ Wyandotte Chemical Corp., which has a molecular weight in the range from 3700–4200 and contains about 3% monostearyl acid phosphate suds suppressant.

Another essential component for use in the compositions of this invention is a sulfonated aromatic compatibilizing agent having a critical micelle concentration greater than about 1%, preferably greater than about 2% at 25° C. As already pointed out hereinbefore, the compatibilizing agent and the nonionic surface-active agents are used in specific weight ratios to obtain the performance advantages of the subject compositions.

The critical micelle concentration (CMC) is determined by plotting the surface tension of a solution of a particular compatibilizing agent versus the logarithm of its concentration, all measurements being made at room temperature (25° C.). The surface tension is measured according to the method set forth in *JOURNAL OF THE AMERICAN CHEMICAL SOCIETY* 52, 1751, (1930) by Harkins, W. D. and Jordan, H. E. Various other techniques can also be used for measuring the surface tension of compatibilizing agents; for example, light scattering measurements as described in *NONIONIC SURFACTANTS,* Chapter 16, Thermodynamics of Micelle Formation, by Hall, D. G. and Pethica, B. A., pages 543–47, Marcel Dekker, New York, 1967.

The critical micelle concentration of the compatibilizing agents herein, being greater than 1%, preferably greater than 2% (weight volume), denotes that during conventional automatic dishwashing operations the detergent concentration being frequently in the range from about 0.1–0.6%, this component does not act as a surface-active agent in the art-established meaning for that term. It is also noteworthy that the preferred compatibilizing agents are known in detergent technology for their hydrotropic properties. In that prior art context, hydrotropes can be functionally defined as being (organic) compounds having hydrophile-hydrophobe properties, and capable in high concentration of increasing the solubility of other organic compounds in water or in aqueous salt solutions. Accordingly, hydrotropes are used as a minor ingredient in liquid detergent compositions to aid and augment the solubility of, for example, relatively high levels of surface-active agents and inorganic detergent builders. The detergent compositions of this invention being solid, pasty or gel-like, or, if liquid, in non-aqueous phase and being also easily soluble, (the term soluble is meant to embrace dispersible) at the conventional automatic dishwashing usage concentration (0.1%–0.6%), it is obvious that the known hydrotrope functionality does not give any clue as to how the compatibilizing agent functions in compositions of the present invention, as is clear from the fact that the agent is equally effective both in solid (granular) and in pasty compositions.

Apparently, however, and without being limited as a result thereof, the compatibilizing agent aids in the processes of soil wetting and hydrolysis of soil on the hard surfaces cleaned. In solution it facilitates the soil dispersion and suspension without interfering itself in the captive process. The compatibilizing agent can also provide interaction with dissolved (dispersed) proteins to hold them in solution via surface-active analogous properties and/or formation of mixed micelles.

The critical micelle concentration (CMC) of sodium cumene sulfonate is >2% at 25° C. while the nonionic ethylene oxide-propylene oxide condensate commercially known as Pluradot HA-433 has under identical conditions a CMC of 0.002%. A mixture of sodium cumene sulfonate and Pluradot HA-433 in equal amounts behaves very much the same as the nonionic by itself, thus indicating that the compatibilizing agent has only a small, if any, effect on the surface-active properties of the nonionic.

As already defined hereinbefore, the compatibilizing agent contains an aromatic and a sulfonate group. The aromatic radical can, for example, be a benzene, a naphthalene or a biphenyl radical, assuming its sulfonated derivative meets the CMC requirement set forth herein. Commercially available examples of sulfonatable compatibilizing agent precursors which can be used in the compositions of this invention include benzene, toluene, xylene, cumene, trimethylbenzene, ethylbenzene and ethylmethylbenzene. Commercial xylene is frequently a mixture of ortho, meta and para species. Similarly, trimethylbenzene can be represented by 1,2,3-trimethylbenzene or hemimellitene; 1,3,5-trimethylbenzene or mesitylene; and 1,2,4-trimethylbenzene or pseudocumene. The above enumeration is not intended to be limiting but a mere exemplification of suitable precursors. Of course, other sulfonatable precursors can qualify for use in the compositions of the instant invention, provided these compounds in sulfonated form meet with the definition herein, especially the minimum critical micelle concentration. The above organic precursors can be sulfonated according to methods known in the art.

Preferred compatibilizing agents include the alkali metal salts of cumene sulfonate, ethylbenzene sulfonate, toluene sulfonate, benzene sulfonate, xylene sulfonate, ethylmethylbenzene sulfonate, trimethylbenzene sulfonate and mixtures thereof.

The compositions of this invention frequently comprise a suds suppressing agent for the purpose of inhibiting the formation of excessive amounts of foam which can impair the mechanical operation of the dishwashing machine due to a lowering of the pressure at which the washing liquor is impelled against the hard surfaces. Of course, the final selection of the suds suppressing agent depends upon and can be required, in part, because of the qualitative and quantitative characteristics of the particular nonionic surface-active agent which is utilized in the automatic dishwashing compositions herein. In addition, food residues, especially proteinaceous food residues, exhibit suds boosting properties and therefore preferably command the presence of an effective suds regulating agent.

Suds regulating components are normally used in an amount from about 0.001% to about 5%, preferably from about 0.05% to about 3% and especially from about 0.10% to about 1%. The suds suppressing (regulating) agents known to be suitable as suds suppressing agents in detergent context can be used in the compositions herein.

Preferred suds suppressing additives are described in U.S. Pat. No. 3,933,672, issued Jan. 20, 1976, inventors Bartolotta et al., incorporated herein by reference, relative to a silicone suds controlling agent. The silicone material can be represented by alkylated polysiloxane materials such as silica aerogels and xerogels and hydrophobic silicas of various types. The silicone material can be described as siloxane having the formula:

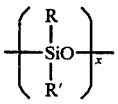

wherein $x$ is from about 20 to about 2,000, and R and R′ are each alkyl or aryl groups, especially methyl, ethyl, propyl, butyl and phenyl. The polydimethylsiloxanes (R and R′ are methyl) having a molecular weight within the range of from about 200 to about 200,000, and higher, are all useful as suds controlling agents. Additional suitable silicone materials wherein the side chain groups R and R′ are alkyl, aryl, or mixed alkyl and aryl hydrocarbyl groups exhibit useful suds controlling properties. Examples of the like ingredients include diethyl-, dipropyl-, dibutyl-, methylethyl-, phenylmethyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Microcrystalline waxes having a melting point in the range from 35° C.–115° C. and saponification value of less than 100 represent an additional example of a preferred suds regulating component for use in the subject compositions. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g. monostearyl phosphate, up to about 50 mole percent of dialkyl phosphate and up to about 5 mole percent of trialkyl phosphate.

In addition to the components described hereinbefore, the compositions according to this invention can contain additional detergent composition ingredients which are known to be suitable for use in automatic dishwashing compositions in the art-established levels for their known functions. Organic and inorganic detergent builder ingredients, alkali materials, sequestering agents, china protecting agents, corrosion inhibitors, soil suspending ingredients, drainage promoting ingredients, dyes, perfumes, fillers, crystal modifiers and the like ingredients represent examples of functional classes of additional automatic dishwashing composition additives. Suitable inorganic builders include polyphosphates, for example tripolyphosphate, pyrophosphate or metaphosphate, carbonates, bicarbonates and alkali silicates. Examples of water-soluble organic builder components include the alkali metal salts of polyacetates, carboxylates, polycarboxylates and polyhydroxy sulfonates. Additional examples include sodium citrate, sodium oxydisuccinate and sodium mellitate. Normally in granular compositions these builder ingredients can be used in an amount up to 60%, preferably in the range from 10% to 50% by weight.

Suitable examples for sequestering agents include alkali metal salts of ethylenediaminetetraacetic acid and nitrilotriacetic acid.

Examples of china protecting agents include silicates, water-soluble aluminosilicates and aluminates. Carboxymethylcellulose is a well-known soil suspending agent for use in dishwashing compositions whereas fillers for granular compositions are mostly represented by sodium sulfate, sucrose, sucrose esters and the like.

Pasty, gel-like or viscous liquid compositions can include many of the above-discussed additional ingredients, but usually at a lower level in view of the higher active concentration. In such compositions, materials which are favored as builders or to provide alkalinity include polyphosphates, carbonates, bicarbonates, silicates, alkanolamines, especially mono-, di- and triethanolamine, and the organic builders and sequestering agents discussed above.

In order to provide satisfactory pasty compositions, a small amount, e.g. up to 20%, of a solvent or solubilizing material or of a gel-forming agent can be included. Most commonly, water is used in this context and forms the continuous phase of a concentrated dispersion. Certain nonionic detergents at high levels form a gel in the presence of small amounts of water and other solvents. Such gelled compositions are also envisaged in the present invention.

In many cases, it is desirable to include a viscosity control agent or a thixotropic agent to provide a suitable product form. For example, aqueous solutions or dispersions of the binary active system of the invention can be thickened or made thixotropic by the use of conventional agents such as methyl cellulose, carboxymethylcellulose, starch, polyvinyl pyrrolidone, gelatin, colloidal silica, natural or synthetic clay minerals, and the like.

The superior dishwashing performance derivable from the conventional use of the compositions of this invention is illustrated by the following examples.

Granular detergent compositions were prepared in a conventional manner having the following formulae:

| Ingredients | % by Weight A | Ex. I |
|---|---|---|
| Ethylene oxide/propylene oxide condensate of trimethylolpropane (1) | 2.6 | 9.7 |
| Sodium cumene sulfonate | — | 10.0 |
| Monostearyl acid phosphate (2) | 0.1 | 0.3 |
| Anhydrous sodium tripolyphosphate | 45.7 | 45.7 |
| Chlorinated trisodium orthophosphate | 22.0 | — |
| Sodium silicate solids ratio: $SiO_2/Na_2O = 2.8$ | 17.0 | 17.0 |
| Moisture and minor ingredients | Balance to 100 | |

(1) and (2) "PLURADOT HA-433" Wyandotte

The above compositions were used for comparative automatic dishwashing to evaluate the spotting and filming performance according to the following procedure.

An automatic dishwashing machine was filled with dishes. Four test glasses (Libbey Safe Edge 10 oz. tumblers #553) were added in predetermined (the same for all tests) positions in the upper rack. Prior to placement in the machine, two of the test glasses were soiled with a thin film of milk by coating them with refrigerated whole milk. Thirty-five grams of a 4:1 weight mixture of homogenized margarine and dry milk were placed in a 50 ml. beaker and inverted in the top rack of the dishwasher. The required amount of detergent product was then added to the dispenser cup. The test consisted of 4 washer cycles whereby the four glasses were graded, at the end of the 4 cycles. The levels of spotting and filming performance were appraised with the aid of a 1–10 scale photographic standards (separate standards for spotting and filming) wherein 1 represents completely unacceptable performance and 10 represents acceptable performance where residual spotting and filming does not occur. The 8 grades (4 spotting; 4 filming) so obtained were averaged to determine average spotting and filming grades.

Additional test parameters were:

| | |
|---|---|
| Product concentration | 0.3% |
| Washing temperature: | 130° F |
| Water hardness: | 15 US grains/gallon |

-continued

| | |
|---|---|
| | (Ca/Mg = 2/1) |

The test results were as follows:

| | Composition A | Example I |
|---|---|---|
| Spotting | 8.2 | 7.9 |
| Filming | 7.9 | 8.1 |

The above results show that excellent automatic dishwashing performance can now be obtained from the composition of this invention (composition Example I) which is substantially free of chlorinated bleach.

Substantially similar results can also be obtained when the sodium cumene sulfonate is replaced with an equivalent amount of sodium toluene sulfonate, sodium xylene sulfonate, sodium benzene sulfonate, sodium trimethylbenzene sulfonate, sodium ethylmethylbenzene sulfonate, sodium ethylbenzene sulfonate, or mixtures thereof.

Substantially similar results are also obtained when the nonionic surfactant of Example I is substituted with a substantially identical alkoxylate containing instead of the trimethylolpropane radical an alkylol selected from the group consisting of propylene glycol, glycerine, pentaerythritol and ethylene diamine. Superior automatic dishwashing performance comparable to Example I is also obtained in replacing the trimethylolpropane alkoxylate by an equivalent amount of the condensation product of one mole of tallow alcohol and 9 moles of ethylene oxide.

An excellent performance is also obtained when the monostearyl acid phosphate of Example I is replaced by a silicone suds suppressant selected from the group consisting of dimethyl-, diethyl-, dipropyl-, dibutyl-, methylethyl-, and phenylmethyl-polysiloxane and mixtures thereof in an amount of 0.1%, 0.2%, 0.3%, 0.35%, 0.4% and 0.45% respectively.

Results substantially comparable to those of Example I can also be obtained when the suds suppressant is represented by a microcrystalline wax having a melting point from 65° C. to 100° C. and which is selected from petrolatum and oxidized petrolatum waxes; Fischer-Tropsch and oxidized Fischer-Tropsch waxes; ozokerite; ceresin; montan wax; beeswax; candelilla and carnauba wax.

Granular detergent compositions were prepared having the following formulae:

| | COMPOSITION IN % BY WEIGHT | | | | |
|---|---|---|---|---|---|
| | | EXAMPLES | | | |
| INGREDIENTS | B | II | III | IV | V |
| Ethylene oxide/propylene oxide condensate of trimethylolpropane (1) | 5 | 10 | 15 | 15 | 15 |
| Monostearyl acid phosphate (2) | 0.15 | 0.3 | 0.45 | 0.45 | 0.45 |
| Sodium cumene sulfonate | — | 10 | 15 | 10 | 15 |
| Sodium carbonate | 30 | 30 | 30 | 30 | 30 |
| Sodium polymetaphosphate $(NaPO_3)_{21}$ | 2 | 2 | 2 | 2 | 2 |
| Sodium siliate solids ratio: $SiO_2/Na_2O = 2.0$ | 20 | 20 | 20 | 20 | 20 |
| Sodium sulfate | | | Balance to 100 | | |

(1) and (2) "PLURADOT HA-433" Wyandotte

The above compositions were used for comparative automatic dishwashing together with a commercial dishwashing formulation — Composition A hereinbefore — to evaluate the spotting and filming performance thereby utilizing the testing procedure set forth in Example I. Data was recorded after 2 washer cycles.

The test results were as follows:

| | COMPOSITION | | | | | |
|---|---|---|---|---|---|---|
| | | EXAMPLES | | | | |
| | B | II | III | IV | V | A |
| Spotting | 6.1 | 8.0 | 7.6 | 8.5 | 7.8 | 8.1 |
| Filming | 6.3 | 7.2 | 7.5 | 7.6 | 7.9 | 7.3 |

The above dishwashing results confirm the superior automatic dishwashing performance obtained from using the compositions of this invention which do not contain a chlorine bleach component.

Additional automatic dishwashing detergent compositions were prepared having the following formulae:

| | COMPOSITION IN % BY WEIGHT | |
|---|---|---|
| INGREDIENT | EX. VI | EX. VII |
| Ethylene oxide/propylene oxide condensate of trimethylolpropane (1) | — | 15 |
| Condensation product of 1 mole tallow alcohol and 9 moles ethylene oxide | 10 | — |
| Monostearyl acid phosphate | — | 0.4 |
| Silicone suds suppressant (2) | 0.2 | — |
| Anhydrous trisodium tripolyphosphate | 46 | 48 |
| Sodium silicate solids ratio: $SiO_2/Na_2O = 2.8$ | 17 | — |
| Sodium silicate solids ratio: $SiO_2/Na_2O = 2.0$ | — | 20 |
| Potassium toluene sulfonate | — | 15 |
| Sodium cumeme sulfonate | 10 | — |
| Sodium sulfate, moisture and minor ingredients | Balance to 100 | |

(1) "Pluradot HA-430" Wyandotte
(2) SAG-100 supplied by Union Carbide Corp.

The above compositions provided during conventional automatic dishwashing superior overall performance, especially reduced spotting and filming comparable to what was obtained with leading commercial active chlorine containing detergent compositions.

Examples of pasty or gel-like compositions are as follows:

EXAMPLE VIII

| Ingredient | % in Composition By Weight |
|---|---|
| Pluradot HA-430 | 30 |
| Sodium cumene sulfonate | 30 |
| SAG-100 | 1 |
| Anhydrous sodium tripolyphosphate | 21 |
| Sodium silicate ($SiO_2/Na_2O = 2.0$) | 17 |
| Minors | 1 |

EXAMPLE IX

| Ingredient | Wt. % in Composition |
|---|---|
| Pluradot HA-430 | 15 |
| Condensation product of 1 mole tallow alcohol and 9 moles ethylene oxide | 15 |
| Sodium toluene sulfonate | 20 |
| Triethanolamine | 20 |
| Oleic acid | 4 |
| Monostearyl acid phosphate | 0.4 |
| SAG-100 | 0.6 |
| Sodium carbonate | 25 |

EXAMPLE X

| Ingredient | Wt. % in Composition |
|---|---|
| Pluradot HA-433 | 40 |
| Sodium cumene sulfonate | 40 |
| Colloidal silica | 4 |
| Oleic acid | 4 |
| Monostearyl acid phosphate | 0.4 |
| SAG-100 | 1 |
| Monoethanolamine | 9 |
| Minors | 1.6 |

EXAMPLE XI

| Ingredient | Wt. % in Composition |
|---|---|
| Condensation product of 6 moles ethylene oxide with 1 mole of tallow alcohol | 30 |
| Sodium cumene sulfonate | 20 |
| Monoethanolamine | 10 |
| Sodium silicate ($SiO_2/Na_2O$ = 2.0) | 20 |
| Polyvinyl pyrrolidone (m.w. = 360,000) | 5 |
| Microcrystalline wax | 1 |
| Minors | 1 |
| Water | 13 |

What is claimed is:

1. A cleaning composition, particularly suitable for use in automatic dishwashers and having improved antiredeposition properties, comprising:

(a) at least about 4% by weight of an alkoxylated low-foaming nonionic surface-active agent, wherein said nonionic surface-active agent is selected from the group consisting of a condensation product of one mole tallow alcohol with from about 6 to about 20 moles of ethylene oxide; an alkoxylate having the formula $$Y[(C_3H_6O)_n(C_2H_4O)_mH]_x$$

wherein $x$ has a value of at least about 2, $n$ has a value such that the molecular weight of the polyoxypropylene hydrophobic base is at least about 900 and $m$ has a value such that the oxyethylene content of the molecule is from about 10% to about 90% by weight, and wherein Y is selected from the group consisting of propylene glycol, glycerine, pentaerythritol, trimethylolpropane, ethylene diamine and mixtures thereof; a polyetherester having the formula $$(ClC_6H_4)_2CHCO_2(CH_2CH_2O)_xR$$

wherein $x$ is an integer from 4 to 20 and R is a lower alkyl group containing not more than 4 carbon atoms; a surfactant having the formula $$Y(C_3H_6O)_n(C_2H_4O)_mH$$

wherein Y is the residue of an organic compound having from about 1 to 6 carbon atoms and one reactive hydrogen atom, $n$ has an average of at least about 6.4, as determined by hydroxyl number, and $m$ has a value such that the oxyethylene portion constitutes about 10 to 90 weight percent of the molecule; a surfactant having the formula $$P[(C_3H_6O)_n(C_2H_4O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxypropylene portion is at least about 58 and $m$ has a value such that the oxyethylene content of the molecule is from about 10 to 90 weight percent; a surfactant having the formula $$P[(C_2H_4O)_n(C_3H_6O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxyethylene portion is at least about 44 and $m$ has a value such that the oxypropylene content of the molecule is from about 10 to 90 weight percent; a condensation product of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; and mixtures of the foregoing surfactants; and (b) at least about 5% by weight of a sulfonated aromatic compatibilizing agent having a critical micelle concentration greater than 1% by weight at 25° C., wherein the weight ratio of said alkoxylated nonionic surface-active agent to said sulfonated compatibilizing agent is in the range from about 2:5 to about 5:3, the compositions being substantially free of a chlorine bleach component and being in a form selected from the group consisting of a solid, a paste, a gel, or a non-aqueous liquid.

2. A composition in accordance with claim 1 wherein the weight ratio of said alkoxylated nonionic to said compatibilizing agent is in the range from about 3:5 to about 5:4.

3. A composition in accordance with claim 2 which, in addition, contains from 0.001% to about 5% of a suds regulating agent.

4. A composition in accordance with claim 3 wherein said compatibilizing agent is selected from the group consisting of an alkali metal salt of benzene sulfonate, toluene sulfonate, xylene sulfonate, cumene sulfonate, trimethyl benzene sulfonate, ethyl benzene sulfonate, ethylmethyl benzene sulfonate and mixtures thereof.

5. A composition in accordance with claim 3 wherein said suds regulating agent is selected from the group consisting of (a) a siloxane having the formula:

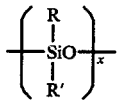

wherein $x$ is from about 20 to about 2,000 and R and R′ are each alkyl or aryl groups;

(b) a microcrystalline wax having a melting point in the range from about 35° C. to about 115° C. and a saponification value of less than 100;

(c) an alkyl phosphate ester component selected from the group consisting of stearyl acid phosphate and oleyl acid phosphate; and (d) mixtures thereof.

6. A composition in accordance with claim 5 wherein said alkoxylated nonionic surface-active agent is selected from the group consisting of a condensation product of one mole tallow alcohol with from about 6 to about 20 moles of ethylene oxide; and an alkoxylate having the formula $$Y[(C_3H_6O)_n(C_2H_4O)_mH]_x$$

wherein $x$ has a value of at least about 2, $n$ has a value such that the molecular weight of the polyoxypropylene hydrophobic base is at least about 900 and $m$ has a value such that the oxyethylene content of the molecule is from about 10% to 90% by weight, and wherein Y is selected from the group consisting of propylene glycol, glycerine, pentaerythritol, trimethylolpropane, ethylene diamine and mixtures thereof.

7. A composition in accordance with claim 6 wherein said compatibilizing agent is selected from the group consisting of an alkali metal salt of benzenesulfonate, toluenesulfonate, xylenesulfonate, cumenesulfonate, trimethylbenzenesulfonate, ethylbenzenesulfonate, ethylmethylbenzenesulfonate and mixtures thereof.

8. A granular cleaning composition, particularly suitable for use in automatic dishwashers, having improved antiredeposition properties comprising:

(a) from about 4% to about 20% by weight of an alkoxylated low-foaming nonionic surface-active agent, wherein said nonionic surface-active agent is selected from the group consisting of a condensation product of one mole tallow alcohol with from about 6 to about 20 moles of ethylene oxide; a polyetherester having the formula $$(ClC_6H_4)_2CHCO_2(CH_2CH_2O)_xR$$

wherein $x$ is an integer from 4 to 20 and R is a lower alkyl group containing not more than 4 carbon atoms; a surfactant having the formula $$Y(C_3H_6O)_n(C_2H_4O)_mH$$

wherein Y is the residue of an organic compound having from about 1 to 6 carbon atoms and one reactive hydrogen atom, $n$ has an average of at least about 6.4, as determined by hydroxyl number, and $m$ has a value such that the oxyethylene portion constitutes about 10 to 90 weight percent of the molecule; a surfactant having the formula $$P[(C_3H_6O)_n(C_2H_4O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxypropylene portion is at least about 58 and $m$ has a value such that the oxyethylene content of the molecule is from about 10 to 90 weight percent; a surfactant having the formula $$P[(C_2H_4O)_n(C_3H_6O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxyethylene portion is at least about 44 and $m$ has a value such that the oxypropylene content of the molecule is from about 10 to 90 weight percent; an alkoxylate having the formula $$Y[(C_3H_6O)_n(C_2H_4O)_mH]_x$$

wherein $x$ has a value of at least about 2, $n$ has a value such that the molecular weight of the polyoxypropylene hydrophobic base is at least about 900 and $m$ has a value such that the oxyethylene content of the molecule is from about 10% to about 90% by weight, and wherein Y is selected from the group consisting of propylene glycol, glycerine, pentaerythritol, trimethylolpropane, ethylene diamine and mixtures thereof; a condensation product of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; and mixtures of the foregoing surfactants;

(b) from about 5% to about 20% by weight of a sulfonated aromatic compatibilizing agent having a critical micelle concentration greater than about 1% by weight at 25° C., wherein the weight ratio of said alkoxylated nonionic surface-active agent to said sulfonated compatibilizing agent is in the range from about 2:5 to about 5:3; and which is substantially free of a chlorine bleach component.

9. A composition in accordance with claim 8 wherein said alkoxylated nonionic surface-active agent and said compatibilizing agent collectively represent from about 9% to about 40% by weight.

10. A composition in accordance with claim 9 wherein the weight ratio of said alkoxylated nonionic to said compatibilizing agent is in the range from about 3:5 to about 5:4.

11. A composition in accordance with claim 10 which, in addition, contains from 0.001% to about 5% by weight of a suds regulating agent.

12. A composition in accordance with claim 11 wherein said alkoxylated nonionic surface-active agent and said compatibilizing agent collectively represent from about 10% to about 30% by weight.

13. A composition in accordance with claim 12 wherein said suds regulating agent is present in an amount of from about 0.05% to about 3% by weight.

14. A composition in accordance with claim 13 wherein said compatibilizing agent is selected from the group consisting of an alkali metal salt of benzene sulfonate, toluene sulfonate, xylene sulfonate, cumene sulfonate, trimethyl benzene sulfonate, ethyl benzene sulfonate, ethylmethyl benzene sulfonate and mixtures thereof.

15. A composition in accordance with claim 13 wherein said suds regulating agent is selected from the group consisting of (a) a siloxane having the formula:

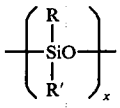

wherein $x$ is from about 20 to about 2,000 and R and R′ are each alkyl or aryl groups;

(b) a microcrystalline wax having a melting point in the range from about 35° C. to about 115° C. and a saponification value of less than 100;

(c) an alkyl phosphate ester component selected from the group consisting of stearyl acid phosphate and oleyl acid phosphate; and (d) mixtures thereof.

16. A composition in accordance with claim 15 wherein said alkoxylated nonionic surface-active agent is selected from the group consisting of a condensation product of one mole tallow alcohol with from about 6 to about 20 moles of ethylene oxide; and an alkoxylate having the formula:

$$Y[(C_3H_6O)_n(C_2H_4O)_mH]_x$$

wherein $x$ has a value of at least about 2, $n$ has a value such that the molecular weight of the polyoxypropylene hydrophobic base is at least about 900 and $m$ has a value such that the oxyethylene content of the molecule is from about 10% to 90% by weight, and wherein Y is selected from the group consisting of propylene glycol, glycerine, pentaerythritol, trimethylolpropane, ethylene diamine and mixtures thereof.

17. A composition in accordance with claim 16 wherein said compatibilizing agent is selected from the group consisting of an alkali metal salt of benzenesulfonate, toluenesulfonate, xylenesulfonate, cumenesulfonate, trimethylbenzenesulfonate, ethylbenzenesulfonate, ethylmethylbenzenesulfonate and mixtures thereof.

18. A composition in accordance with claim 17 wherein R and R′ of said siloxane suds regulating agent are selected from the group consisting of methyl, ethyl, propyl, butyl, phenyl and mixtures thereof.

19. A composition in accordance with claim 17 wherein said microcrystalline wax suds regulating agent has a melting point from about 65° C. to about 100° C. and is selected from the group consisting of microcrystalline and oxidized microcrystalline petrolatum waxes, Fischer-Tropsch and oxidized Fischer-Tropsch waxes, ozokerite, ceresin, montan wax, beeswax, candelilla, carnauba and mixtures thereof.

20. A composition in accordance with claim 17 wherein the weight ratio of said nonionic alkoxylate to said compatibilizing agent is about 1:1.

21. A pasty or gelled cleaning composition, particularly suitable for use in automatic dishwashers and having improved antiredeposition properties, comprising:

(a) from about 6% to about 55% by weight of an alkoxylated low-foaming nonionic surface-active agent, wherein said nonionic surface-active agent is selected from the group consisting of a condensation product of one mole tallow alcohol with from about 6 to about 20 moles of ethylene oxide; a polyetherester having the formula $$(ClC_6H_4)_2CHCO_2(CH_2CH_2O)_xR$$

wherein $x$ is an integer from 4 to 20 and R is a lower alkyl group containing not more than 4 carbon atoms; a surfactant having the formula $$Y(C_3H_6O)_n(C_2H_4O)_mH$$

wherein Y is the residue of an organic compound having from about 1 to 6 carbon atoms and one reactive hydrogen atom, $n$ has an average of at least about 6.4, as determined by hydroxyl number, and $m$ has a value such that the oxyethylene portion constitutes about 10 to 90 weight percent of the molecule; a surfactant having the formula $$P[(C_3H_6O)_n(C_2H_4O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxypropylene portion is at least about 58 and $m$ has a value such that the oxyethylene content of the molecule is from about 10 to 90 weight percent; a surfactant having the formula $$P[(C_2H_4O)_n(C_3H_6O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxyethylene portion is at least about 44 and $m$ has a value such that the oxypropylene content of the molecule is from about 10 to 90 weight percent; an alkoxylate having the formula $$Y[(C_3H_6O)_n(C_2H_4O)_mH]_x$$

wherein $x$ has a value of at least about 2, $n$ has a value such that the molecular weight of the polyoxypropylene hydrophobic base is at least about 900 and $m$ has a value such that the oxyethylene content of the molecule is from about 10% to about 90% by weight, and wherein Y is selected from the group consisting of propylene glycol, glycerine, pentaerythritol, trimethylolpropane, ethylene diamine and mixtures thereof; a condensation product of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; and mixtures of the foregoing surfactants;

(b) from about 7.5% to about 65% by weight of a sulfonated aromatic compatibilizing agent having a critical micelle concentration greater than 1% by weight at 25° C., wherein the weight ratio of said alkoxylated nonionic surface-active agent to said sulfonated compatibilizing agent is in the range from about 2:5 to about 5:3; and which is substantially free of a chlorine bleach component.

22. A composition in accordance with claim 21 wherein said alkoxylated nonionic surface-active agent and said compatibilizing agent collectively represent from about 20% to about 90% by weight.

23. A composition in accordance with claim 22 wherein the weight ratio of said alkoxylated nonionic to said compatibilizing agent is in the range from about 3:5 to about 5:4.

24. A composition in accordance with claim 23 which, in addition, contains from 0.001% to about 5% by weight of a suds regulating agent.

25. A composition in accordance with claim 24 wherein said suds regulating agent is present in an amount of from about 0.05% to about 3% by weight.

26. A composition in accordance with claim 25 wherein said compatibilizing agent is selected from the group consisting of an alkali metal salt of benzene sulfonate, toluene sulfonate, xylene sulfonate, cumene sulfonate, trimethyl benzene sulfonate, ethyl benzene sulfonate, ethylmethyl benzene sulfonate and mixtures thereof.

27. A composition in accordance with claim 25 wherein said suds regulating agent is selected from the group consisting of (a) a siloxane having the formula:

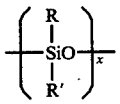

wherein $x$ is from about 20 to about 2,000 and R and R′ are each alkyl or aryl groups;

(b) a microcrystalline wax having a melting point in the range from about 35° C. to about 115° C. and a saponification value of less than 100;

(c) an alkyl phosphate ester component selected from the group consisting of stearyl acid phosphate and oleyl acid phosphate; and (d) mixtures thereof.

28. A composition in accordance with claim 27 wherein said alkoxylated nonionic surface-active agent is selected from the group consisting of a condensation product of one mole tallow alcohol with from about 6 to about 15 moles of ethylene oxide; and an alkoxylate having the formula:

$$Y[(C_3H_6O)_n(C_2H_4O)_mH]_x$$

wherein $x$ has a value of at least about 2, $n$ has a value such that the molecular weight of the polyoxypropylene hydrophobic base is at least about 900 and $m$ has a value such that the oxyethylene content of the molecule is from about 10% to 90% by weight, and wherein Y is selected from the group consisting of propylene glycol, glycerine, pentaerythritol, trimethylolpropane, ethylene diamine and mixtures thereof.

29. A composition in accordance with claim 28 wherein said compatibilizing agent is selected from the group consisting of an alkali metal salt of benzenesulfonate, toluenesulfonate, xylenesulfonate, cumenesulfonate, trimethylbenzenesulfonate, ethylbenzenesulfonate, ethylmethylbenzenesulfonate and mixtures thereof.

30. A composition in accordance with claim 29 wherein R and R′ of said siloxane suds regulating agent are selected from the group consisting of methyl, ethyl, propyl, butyl, phenyl and mixtures thereof.

31. A composition in accordance with claim 27 wherein said microcrystalline wax suds regulating agent has a melting point from about 65° C. to about 100° C. and is selected from the group consisting of microcrystalline and oxidized microcrystalline petrolatum waxes, Fischer-Tropsch and oxidized Fischer-Tropsch waxes, ozokerite, ceresin, montan wax, beeswax, candelilla, carnauba and mixtures thereof.

* * * * *